United States Patent [19]

Mäkinen et al.

[11] Patent Number: 4,499,972

[45] Date of Patent: Feb. 19, 1985

[54] SPEED CONTROL SYSTEM FOR A MOTOR WITH SHORT-CIRCUITED ROTOR

[75] Inventors: Heimo Mäkinen; Seppo Suur-Askola, both of Hyvinkää , Finland

[73] Assignees: Elevator GmbH, Baar, Switzerland; Kone Oy, Helsinki, Finland

[21] Appl. No.: 441,519

[22] PCT Filed: Mar. 4, 1982

[86] PCT No.: PCT/FI82/00008

§ 371 Date: Nov. 2, 1982

§ 102(e) Date: Nov. 2, 1982

[87] PCT Pub. No.: WO82/03067

PCT Pub. Date: Sep. 16, 1982

[30] Foreign Application Priority Data

Mar. 4, 1981 [FI] Finland ..... 810676

[51] Int. Cl.[3] ..... B66B 1/28

[52] U.S. Cl. ..... 187/29 R; 318/375; 318/759

[58] Field of Search ..... 318/375, 376, 759, 760, 318/761; 187/29, 29 R

[56] References Cited

U.S. PATENT DOCUMENTS

| | | | |
|---|---|---|---|
| 2,733,393 | 1/1956 | Carlisle | 187/29 R X |
| 2,922,094 | 1/1960 | Peterson | 318/375 X |
| 2,978,070 | 4/1961 | Hesse et al. | 318/375 X |
| 3,153,182 | 10/1964 | Shafi-Uddin | 318/759 |
| 3,393,773 | 7/1968 | Rufli et al. | 187/29 R |
| 3,678,353 | 7/1972 | Marchi | 318/375 X |
| 3,687,235 | 8/1972 | Mitsui et al. | 318/375 X |
| 3,906,318 | 9/1975 | Kjellberg et al. | 187/29 |
| 3,918,552 | 11/1975 | Kameyama et al. | 187/29 R |
| 4,083,431 | 4/1978 | Oohira et al. | 187/29 R |
| 4,351,415 | 9/1982 | Kita | 187/29 B |

FOREIGN PATENT DOCUMENTS

| | | | |
|---|---|---|---|
| WO82/03067 | 9/1982 | PCT Int'l Appl. | 187/29 R |

*Primary Examiner*—J. V. Truhe
*Assistant Examiner*—Paul Shik Luen Ip

[57] ABSTRACT

An elevator speed control system permitting rotation of the motor with short-circuited rotor at full speed, wherein the thyristors controlling said motor permit the motor to rotate at full speed and when the elevator is running in the lighter direction, operation of the motor as generator at an over-synchronous speed. The system comprises a control unit assembled of components known in themselves in the art by which the instruction value is increased considerably past the actual value, whereby the motor with short-circuited rotor is left to rotate at full speed, and that on commencing retardation the instruction value is dropped directly to be consistent with the actual value.

2 Claims, 5 Drawing Figures

SPEED CONTROL SYSTEM FOR A MOTOR WITH SHORT-CIRCUITED ROTOR

The object of the present invention is an elevator speed control system permitting full speed of rotation of a motor with short-circuited rotor (so-called squirrel-cage motor), wherein the thyristors controlling the squirrel-cage motor permit the motor's rotation at full speed and permit, when the elevator is running in the lighter direction, operation of the motor as generated at over-synchronous speed.

It has long been known that an elevator motor may be used as generator, but in carrying out this idea there have been difficulties and it has never been introduced in practice. Therefore the old technology has persisted, according to which in the elevator's control system the actual value follows the instruction value also when running at top speed, i.e., the top speed is fixed. This results in the following drawbacks. The thermal losses are higher while running at top speed because the speed is controlled by braking the elevator when running in the lighter direction. A bigger motor is also required. The motor's highest possible speed of rotation cannot be used, owing to retention of a control margin.

The object of the present invention is to eliminate the drawbacks mentioned. The speed control system of the invention is characterized in that it comprises a controller unit assembled of components known in themselves in the art and by which the instruction value of the speed controller is increased to be considerably in excess of the actual value, whereby the squirrel-cage motor remains running at full speed, and that when commencing retardation the instruction value is dropped to be directly consistent with the actual value.

By the aid of the invention the motor of the elevator may be operated as generator at over-synchronous speed of rotation when the elevator is running in the lighter direction. The kinetic energy of the elevator is fed back into the mains and savings of electricity are achieved. No separate braking system is required for limiting the elevator's speed to its nominal speed. The thermal losses of the motor are lower than in the case that the motor speed is braked down to a given top speed.

One favourable embodiment of the invention is characterized in that the drop of the instruction value to the actual value is controllable. By the system, exceedingly simple control of deceleration is rendered possible without any change of shaft data or retardation calculator values. It should be noted that the linearity of control is not changed although the control of deceleration is performed in this way. The simplicity of this control makes possible a deceleration value as desired by the customer, an instance being hospitals, where it has to be low, and another example hotels, where it should be high in contrast.

Figure 1:
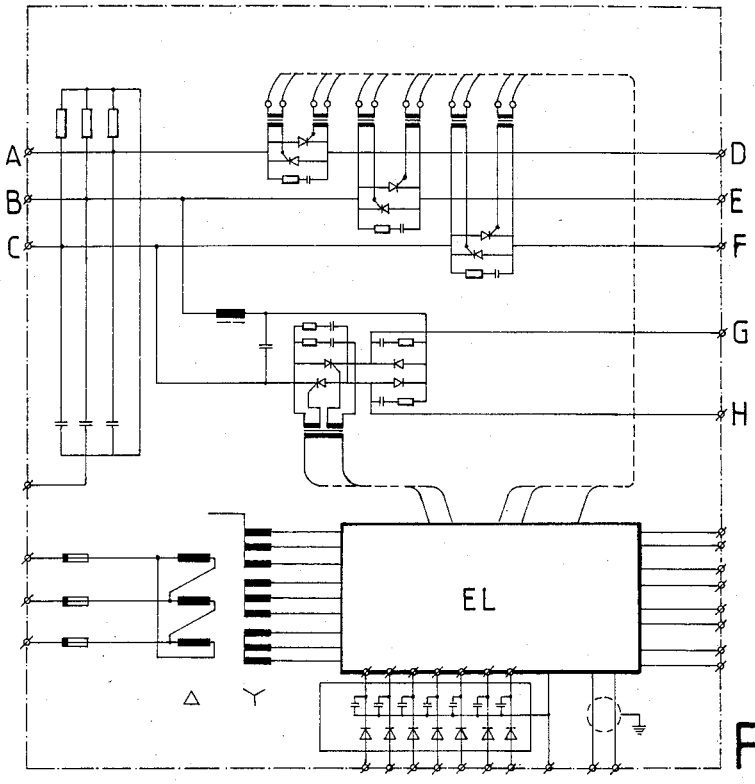

The invention is described in the following with the aid of an example, referring to the attached drawings, wherein:

FIG. 1 presents the principle of the speed control system.

Figure 2:
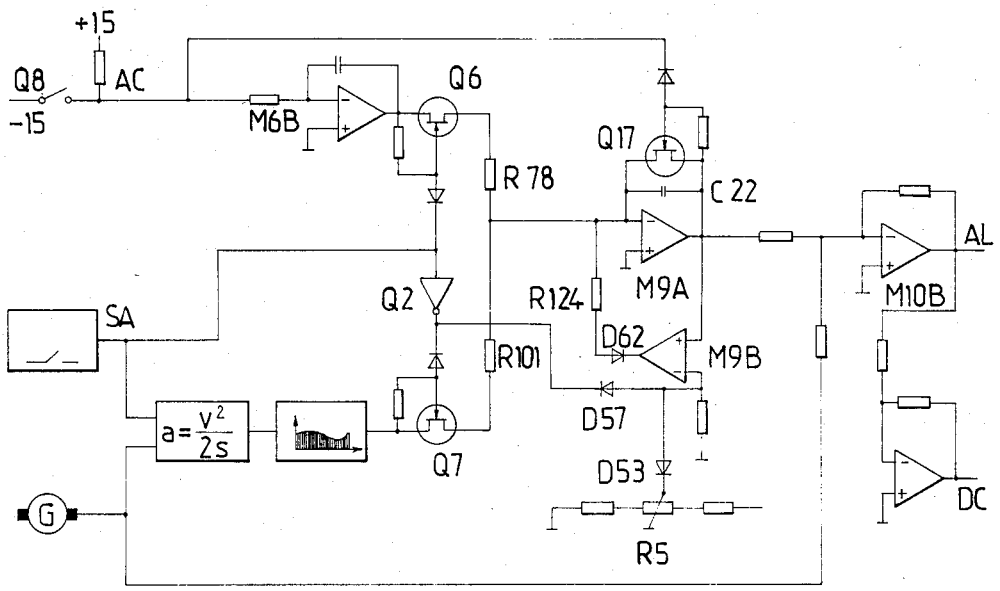

FIG. 2 presents the simplified circuit diagram of the control unit.

Figures 3, 4, 5:
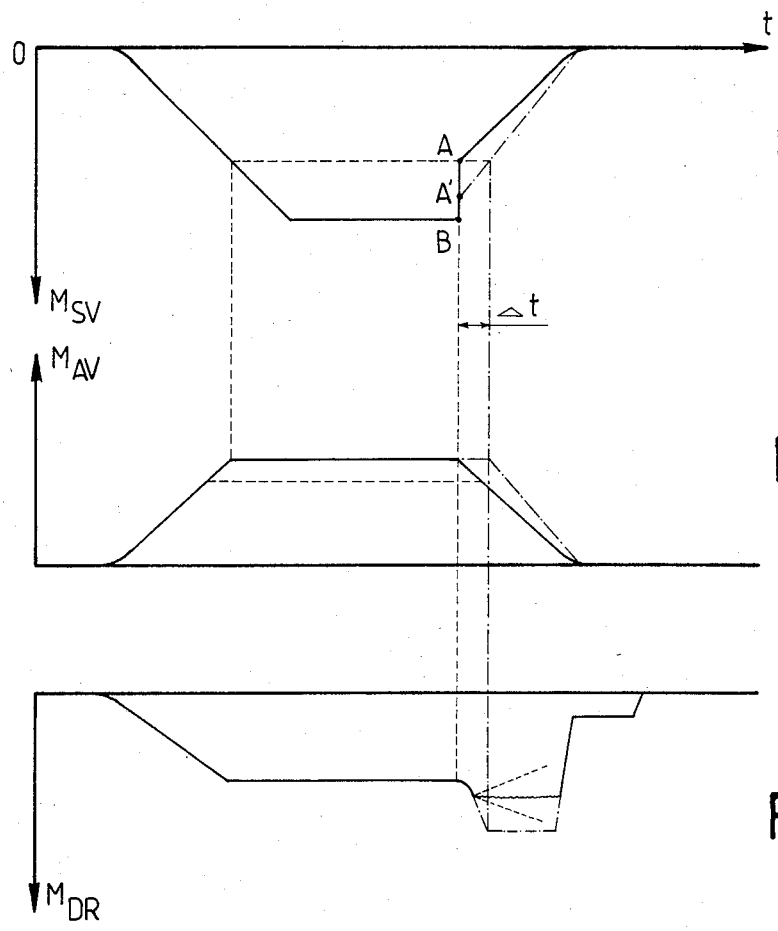

FIGS. 3–5 displays the speed controller's instruction and actual values, and the deceleration instruction, referred to time.

Three-phase current is supplied to the speed control system at the points A, B and C. The elevator motor is connected to D, E and F. The motor's braking circuits are connected to G and H. The control unit is EL, and its operational description is associated with FIGS. 2, 3, 4 and 5.

In the elevator's starting point situation, the start-of-retardation information SA="1" is set. The switch Q6 is conductive and Q7 is non-conductive. The output of Q2 assumes negative (−15 V) voltage. Since D57 and D53 constitute a smaller voltage selection circuit, the inverting (−) input of M9B also assumes negative (−15 V) voltage. The output of M9B is then at positive (+15 V) voltage. D62 presents its blocking direction to this voltage, whence the current flowing in resistor R124 is zero. Acceleration is started with the switch Q8, whereby AC=−15 V, and the switch Q17 changes to non-conductive state. The start rounding circuit M6B supplies the acceleration instruction, whence the velocity instruction is formed by integration by the circuit R78, C22 and M9A. After the motor has reached full rotational speed value, the acceleration instruction is left to act further on, whence the velocity instruction further increases (FIG. 3). Since the instruction increases past the actual value, the controller M10B tends to increase the speed, with the consequence of full conduction of the thyristors ($\gamma=180°$). When from the shaft start-of-retardation information (SA="0") is received, switch Q7 turns conductive and Q6 turns non-conductive. The output of Q2 goes to positive (+15 V) voltage. Diode D53 now selects the voltage at the negative input of the instruction return circuit M9B, which has been adjusted by means of the return point regulating potentiometer R5. Since the velocity instruction is more strongly negative, the output voltage of M9B is negative (−15 V). The diode D62 is now biased in admission direction and the capacitor C22 is discharged through the resistor R124 until the velocity instruction is at the same value as the negative (−) input of M9B. This voltage is approximately the same as the voltage on the regulation pin of potentiometer R5. It is thus understood that a drop of instruction takes place from B to A (FIG. 3). Since the instruction value MSV is now the same as the actual value $M_{AV}$, the output voltages of the controllers are zero (AL=0, DC=0) (without returning circuit, AL=+15 and DC=−15 V).

The deceleration instruction $M_{DR}$, which is formed on the basis of the elevator's speed and the distance on the level, is integrated (circuit R101, C22 and M9A), whereby the velocity instruction is obtained. Since the positive output voltage of the braking voltage controller implies a braking torque, the retardation will indeed commence immediately after the velocity instruction has dropped to A and is dropping towards zero.

Since the value of the returning point A is adjustable by the potentiometer R5, the drop may equally be made to A′ (FIG. 3). In that case the retardation only starts after the delay Δt, when the instruction has reached the corresponding value of the actual value. During the delay period Δt the deceleration instruction increases because the elevator speed has not decreased any. When the actual value and the instruction value becomes equal, the value of the deceleration instruction (FIG. 5) will be higher and therefore the deceleration of the elevator is higher. Good linearity of control is still maintained independent of whether the drop has been made to A or A′, since only that time is concerned here which the controller uses while in non-active state.

We claim:

1. Elevator speed control system including a drive circuit for a motor which lifts the elevator, the drive circuit having thyristors connected to windings of the motor, the motor having a short-circuited rotor, characterized in that the system operates the thyristors for controlling said motor to permit full speed rotation of the motor; and while the elevator is running in the downward direction, said drive circuit connects with said motor for operation of the motor as a generator at an over-synchronous speed of rotation, and wherein the drive circuit comprises a control unit having a speed controller forming a command speed signal having a value which is increased to be considerably in excess of the actual value of elevator speed, whereby the motor with short-circuited rotor is left to rotate at full speed, and wherein said drive circuit initiates a retardation of the elevator by reducing the value of the command-speed signal to equal the actual value of elevator speed.

2. Speed control system according to claim 1, wherein the reduction in the value of the command-speed signal to the actual value of the elevator speed is adjustable.

* * * * *